US006398026B1

(12) United States Patent
Parsons

(10) Patent No.: US 6,398,026 B1
(45) Date of Patent: Jun. 4, 2002

(54) PROTECTIVE PACKAGE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/593,643

(22) Filed: Jun. 13, 2000

(51) Int. Cl.[7] ..... B65D 81/02
(52) U.S. Cl. ..... 206/349; 206/521; 206/587
(58) Field of Search ..... 206/6.1, 320, 459.5, 206/462, 470, 471, 521, 523, 533, 587, 588, 589, 590, 301, 349

(56) References Cited

U.S. PATENT DOCUMENTS

| | | | | |
|---|---|---|---|---|
| 3,286,905 A | * | 11/1966 | Farukhi | 206/459.5 |
| 3,596,754 A | | 8/1971 | Peterson | |
| 4,119,204 A | | 10/1978 | Peckar | |
| 4,166,531 A | * | 9/1979 | Fujiwara | 206/320 |
| 4,824,059 A | | 4/1989 | Butler | |
| 4,828,115 A | * | 5/1989 | Wiegand et al. | 206/590 |
| 5,148,920 A | | 9/1992 | Walker | |
| 5,358,099 A | * | 10/1994 | Tavone | 206/6.1 |
| 5,593,036 A | | 1/1997 | Dyble et al. | |
| 5,664,697 A | * | 9/1997 | Lambelet, Jr. et al. | 206/533 |
| 5,752,600 A | * | 5/1998 | Kurashina et al. | 206/301 |
| 5,833,057 A | * | 11/1998 | Char et al. | 206/523 |
| 5,849,378 A | * | 12/1998 | Gask | 206/470 |
| 5,871,096 A | * | 2/1999 | Yakich | 206/459.5 |
| 5,888,565 A | * | 3/1999 | Gics | 206/462 |
| 5,979,643 A | * | 11/1999 | Blonder et al. | 206/459.5 |
| 5,984,103 A | | 11/1999 | Stirmel | |

OTHER PUBLICATIONS

Pending U.S. Design Patent Application Ser. No. 29/078,936 Filed Oct. 24, 1997.
Pending U.S. Design Patent Application Ser. No. 29/078,938 Filed Oct. 24, 1997.

* cited by examiner

*Primary Examiner*—Jim Foster
(74) *Attorney, Agent, or Firm*—Welsh & Katz, Ltd.

(57) ABSTRACT

The present invention is directed to packaging that is inexpensive, stylish and easily wrapped, and is acceptable to higher end retailers. The packaging of the present invention includes a base having a cavity with a flocked surface for supporting a product, a cover fitted over the base, and a sleeve that is slipped onto the base and the cover. The sleeve may be provided with written information relating to the product. A card for displaying graphical indicia or written information relating to the product may be provided on a bottom surface of the base. The packaging cushions the product, and is durable and impact resistant. Because the sleeve of the packaging may be provided with a perforation and the cover can be removed from the base, the package is easily opened for inspecting the product contained therein and may be readily resealed.

22 Claims, 2 Drawing Sheets

PROTECTIVE PACKAGE

FIELD OF THE INVENTION

This invention relates generally to the field of protective and supportive packaging and, more particularly, to packaging for a product such as a flashlight.

BACKGROUND OF THE INVENTION

A traditional manner of packaging products involves housing the product within a clear plastic blister that is fused to a paperboard card or within a clear plastic clamshell. Product information may be supplied on the card or within the clamshell. Such blister cards or clamshells are acceptable forms of packaging for lower end retailers and mass merchants. However, this type of packaging is difficult to wrap. As a result, it is not desirable for giftable products. In addition, the packaging is not acceptable for higher end retailers such as jewelry, upscale gift or specialty stores.

Further, blister cards are easily damaged with the cards becoming dog-eared and unsightly. The thin plastic covering of both blister cards and clamshells is placed in direct contact with the product. This direct contact with the thin plastic covering exposes the product to potential damage during shipment and subsequent handling, in the event the package is accidentally dropped or subjected to other undesirable forces in a retail environment.

Additionally, blister cards and clamshells are difficult to open. They do not readily allow the customer to examine, handle, feel or test the product. The package must be virtually destroyed to contact the product. This difficulty in opening the packaging has resulted in products being scratched, cut or damaged while being removed from the package. Once the package has been opened, it becomes difficult for the merchant to sell a product in an opened blister card or clamshell. Merchants must often resort to staples or tape in an effort to re-seal an opened package. This results in an unsightly presentation of the product that is undesirable in an upscale retail environment.

Protective cases traditionally used for jewelry allow the product to be displayed, examined, and re-packaged for sale. However such packaging is extremely expensive, requiring that the product be sold for a significantly higher price to cover the cost of the packaging.

Thus, there is a need in the art for inexpensive packaging that can contain product information, is easily wrapped, and is acceptable to higher end retailers while capable of cushioning the product.

There is a further need in the art for packaging that may be easily opened and readily re-sealed.

SUMMARY OF THE INVENTION

The present invention meets the needs of the prior art by providing inexpensive, stylish packaging that is easily wrapped, and is acceptable to higher end retailers. The packaging of the present invention includes a base having a cavity with a flocked surface for supporting a product, a cover fitted over the base, and a sleeve that is slipped onto the base and the cover. The sleeve may be provided with written information relating to the product. A card for displaying graphical indicia or written information relating to the product may be provided on a bottom surface of the base. The packaging cushions the product, and is durable and impact resistant. Because the sleeve of the packaging may be provided with a perforation and the cover can be removed from the base, the package is easily opened for inspecting the product contained therein and may be readily resealed.

DETAILED DESCRIPTION OF THE INVENTION

Figure 1:
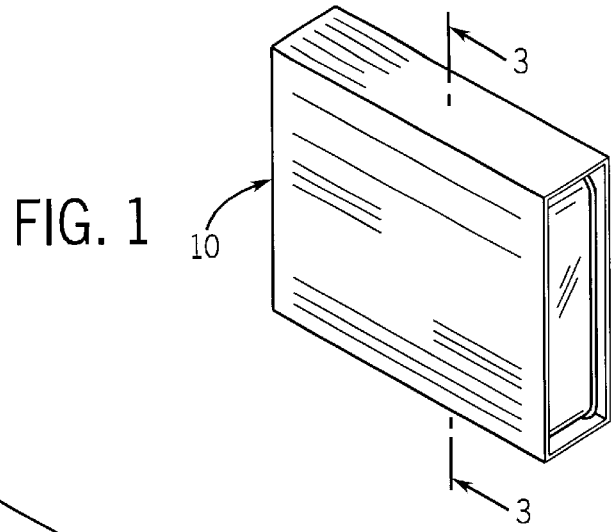
FIG. 1 is a perspective view of the present invention.

The present invention is directed to packaging 10 depicted in FIGS. 1–5. The packaging 10 generally comprises a base 12, a cover 14, and a sleeve 16, and may further include a card 18.

Figure 2:
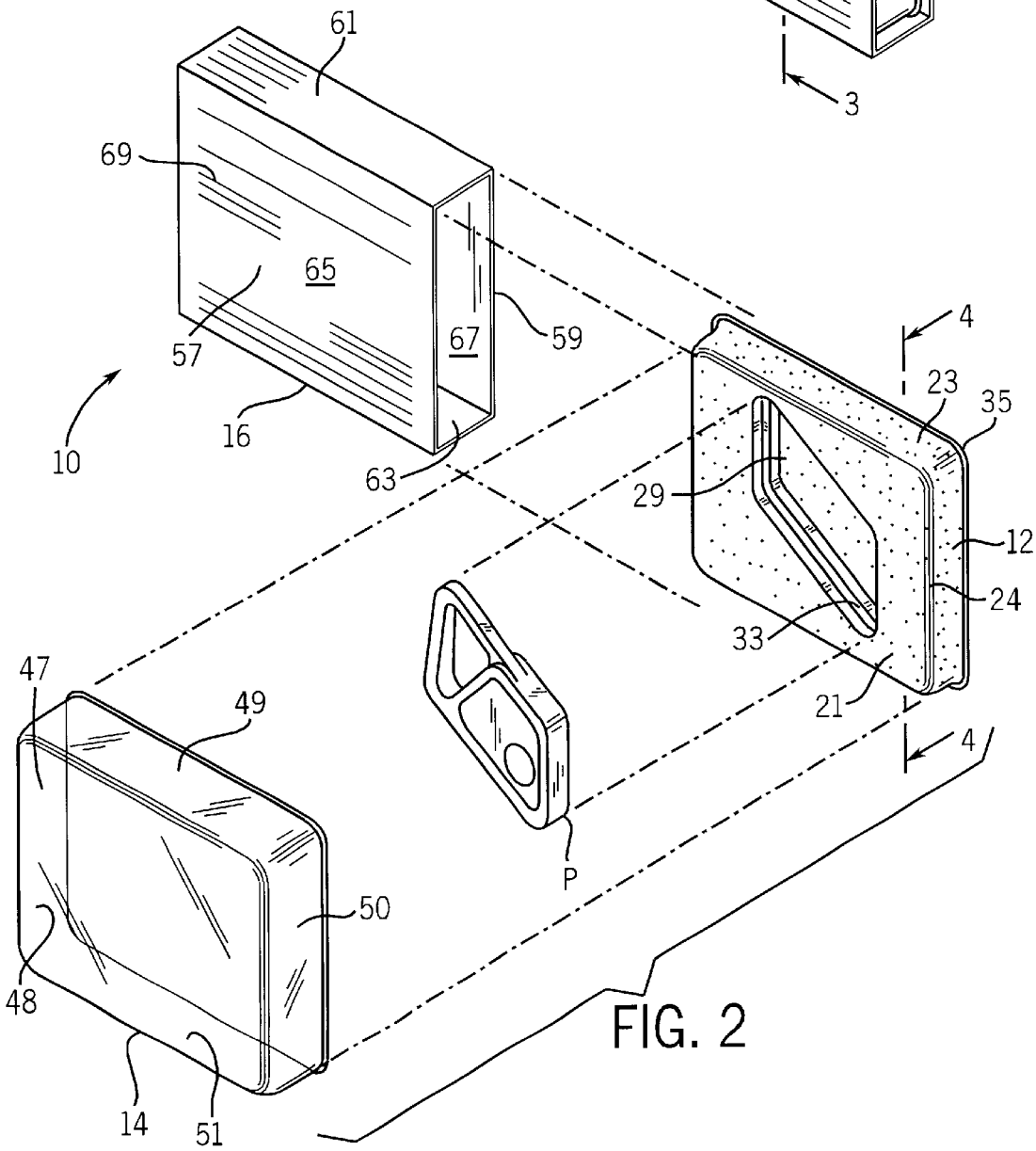
FIG. 2 is an exploded perspective view of the present invention.
Figure 3:
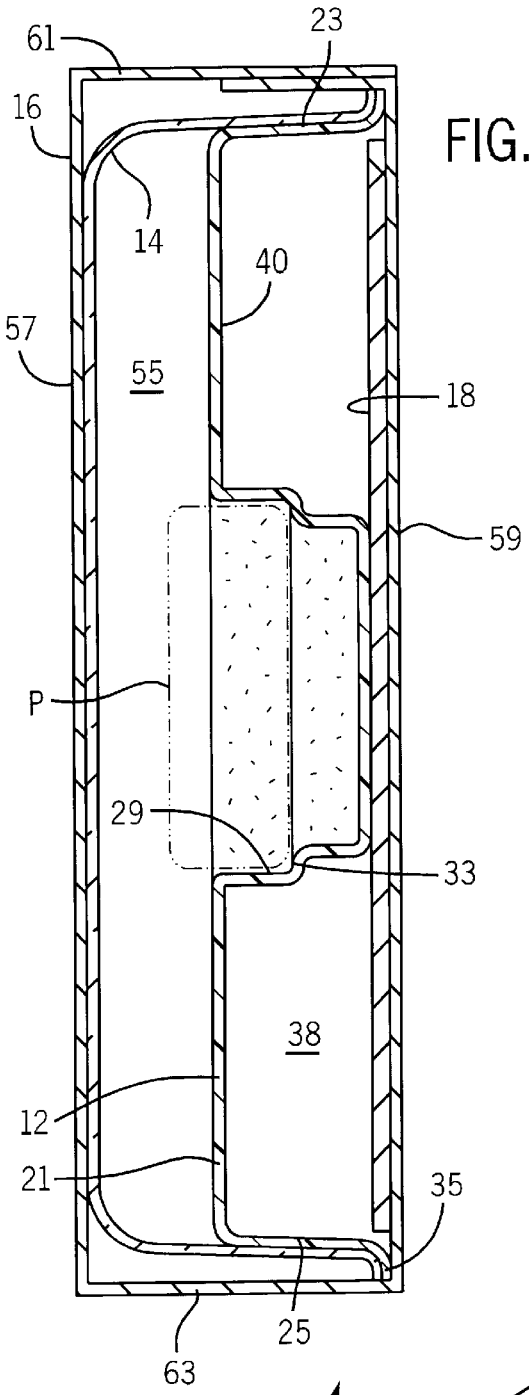
FIG. 3 is a cross-sectional view of the present invention taken along line 3—3.

As can be seen in FIG. 2, the base 12 is provided with an upper wall 21 and four side walls 23, 24, 25 and 26 extending from the upper wall 21. The upper wall 21 includes a cavity or recess 29 having a shape corresponding to that of the product P to be carried. As can be seen in FIGS. 2 and 3, the cavity 29 is provided with a ridge 33 for supporting the product P. The upper wall 21, including the cavity 29, and the side walls 23–26 are provided with a flocked styrene surface, which provides a tight fit between the product P and the cavity 29, and secures the product P therein. The advantage that results from the presence of a flocked surface is that the fibers of the flocking are "crushed" when the product is inserted and as a result hold the product in place in the cavity 29. In contrast, if the walls were made of a smooth plastic material, they would not hold the product in place during shipment and would not allow the use of an air cushion above the product, as described below.

The base 12 also includes a ridge or flange 35 about its lower perimeter, the ridge 35 limiting the extent that the cover 14 can be fitted over the base 12. A recess 38 is formed on the underside of the base 12, between the bottom surface 40 of the cavity 29 and the side walls 23–26. The base 12 is generally rectangular in shape. It should be understood that the base 12 could be made of other suitable materials and could have alternative shapes without departing from the spirit of the invention.

Figure 4:
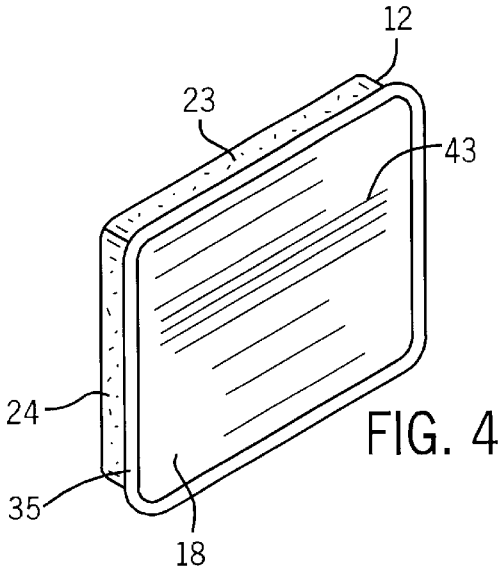
FIG. 4 is a rear view of the base of the present invention taken along line 4—4.

As depicted in FIGS. 3 and 4, the base 12 may further be provided with a card 18 for displaying graphical indicia or written information 43 relating to the product. As shown in FIG. 4, the card 18 fits within the recess 38 of the base 12. The card 18 is attached to the bottom surface 40 of the cavity 29 by the use of tape (not shown). However, other attaching means could also be used. Alternately, the card 18 can be held in place by a preformed flange (not shown) extending about the lower perimeter of the base 12. The card 18 is preferably made of a material such as paperboard, but may be made of other generally rigid materials, such as printed plastic.

Referring to FIG. 2, the cover 14 is provided with an upper wall 47 and four side walls 48, 49, 50 and 51 extending therefrom. As can be seen in FIG. 3, the cover 14 fits over the base 12 until the side walls 48–51 of the cover 14 come into contact with the ridge 35 of the base 12. The cover 14 is constructed of a transparent plastic and is generally rectangular in shape. It should be understood that the cover 14 could be made of other suitable materials and could have alternative shapes. As depicted in FIG. 3, the cover 14 provides a gap 55 between the upper wall 21 of the base 12 and the upper wall 47 of the cover 14. The side walls 48–51 of the cover 14 fit snugly about the side walls 23–26 of the base 12, thereby forming an air cushion between the upper wall 21 of the base 12 and the upper wall 47 of the cover 14 to prevent the crushing of the product P fitted in the base 12.

Figure 5:
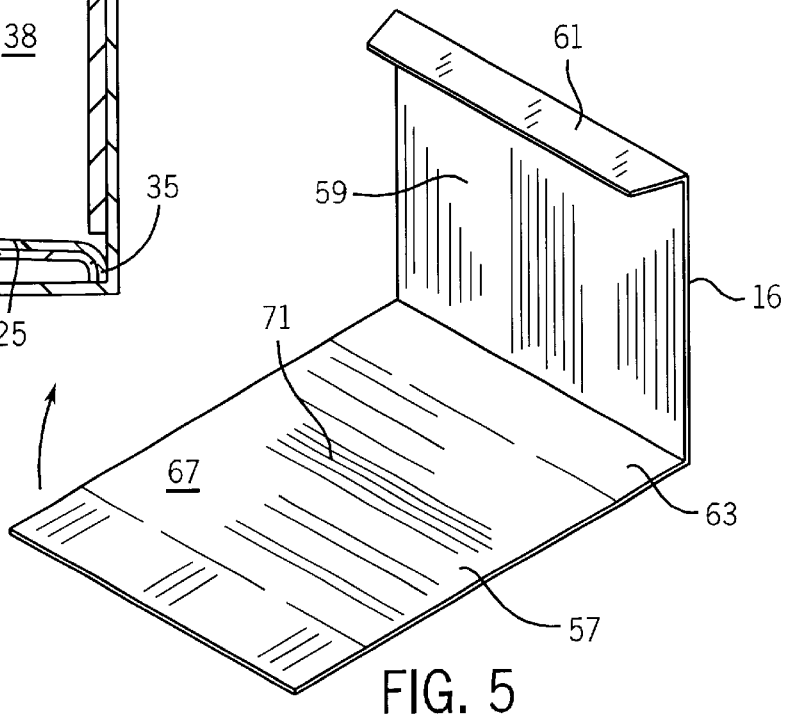
FIG. 5 is a perspective view of the sleeve of the present invention, depicting the inner surface of the sleeve.

As shown in FIGS. 2, 3 and 5, the sleeve 16 is formed by a top wall 57 and a bottom wall 59, joined together by two side walls 61, 63. It further has an outer surface 65 and an inner surface 67. It is preferably constructed of cardboard. The outer surface 65 may be provided with graphical indicia 69 relating to the product P while the inner surface 67 may be provided with written information 71 relating to the product P. Such written information 71 includes, but is not limited to, product warranty information.

The sleeve 16 may be perforated to allow it to be easily opened by a consumer. Further, the sleeve 16 could be provided with a re-sealable adhesive on a portion that overlaps one of the walls to allow a consumer to open the sleeve to read the written information 71 and then re-close the sleeve.

As can be seen in FIG. 2, the sleeve 16 is slipped over the base 12 and the cover 14 to hold them together. The dimensions of the sleeve 16 preferably correspond to the width of the ridge 35 of the base and the height of the combined base 12 and cover 14. The sleeve 16 provides further protection to the product P.

Referring to FIGS. 2 and 3, the use of the present invention will now be described. First, the optional card 18 is attached to the bottom surface 40 of the cavity 29. The appropriate product P is placed within the cavity 29 of the base 12. The flocked surface of the cavity 29 ensures a tight fit between the product P and the cavity 29. The cover 14 is then placed over the base 12, until the side walls 23–26 of the base 12 contact the ridge 33 of the base 12. Lastly, the base 12 with the cover 14 in place is slipped into the sleeve 16. The package 10 is then ready to be shipped and placed in a retail environment.

While the invention has been described in connection with certain embodiments, it should be understood that it is not intended to limit the invention to these particular embodiments. To the contrary, it is intended to cover all alternatives, modifications and equivalents falling within the spirit and scope of the invention. For example, the packaging 10 is shown carrying a flashlight P. However, the packaging can be used for other products.

What is claimed is:

1. Packaging for a product, comprising:

a base having a first surface with a product-receiving cavity conformably accommodating the product and side walls extending from the first surface;

said cavity extending in the same direction as the side walls, having a shape corresponding to product and constructed to releasably grasp product positioned in the cavity;

a cover for covering the base, the cover having side walls, and a sleeve capable of being slipped over the base and the cover, wherein the side walls of the cover mate with the side walls of the base, thereby forming an air cushion between the cover and base for preventing crushing of the product fitted in the base; and wherein the first surface of the base is flocked so as to cooperate in releasably grasping product in the cavity.

2. The packaging of claim 1 wherein the side walls of the base are flocked.

3. The packaging of claim 1 wherein the base is constructed of styrene.

4. The packaging of claim 1 further comprising a card for displaying graphical indicia relating to the product, the card provided on a second surface of the base.

5. The packaging of claim 4 wherein the card is provided on a bottom surface of the base.

6. The packaging of claim 1 wherein the cover is constructed of a transparent material.

7. The packaging of claim 1 wherein the cover is constructed of plastic.

8. The packaging of claim 1 wherein the sleeve comprises a top wall, a bottom wall, and side walls.

9. The packaging of claim 1 wherein the sleeve is provided with an outer surface and an inner surface.

10. The packaging of claim 9 wherein the outer surface is provided with graphical indicia relating to the product.

11. The packaging of claim 10 wherein the inner surface is provided with information relating to the product.

12. The packaging of claim 1 wherein the product is a flashlight.

13. The packaging of claim 1 wherein the first surface defines a product engaging rib-like construction, within and extending into the cavity so as to engage product and limit movement of product into the cavity.

14. The packaging of claim 13 wherein the rib-like construction extends into the cavity and substantially about the interior of the cavity.

15. The packaging of claim 1 wherein the base side walls each include a lower edge and a flange extending from each lower edge in a direction away from the cavity and constructed to cooperate with the cover and limit the extent to which the cover can be fitted over the base.

16. The packaging of claim 12 wherein the flashlight has a parallelogram-like shape and the cavity has a parallelogram-like shape for receiving and grasping the flashlight.

17. Packaging for a product, comprising:

a base having a first surface with a product receiving cavity for conformably accommodating the product and side walls extending from the first surface, said cavity extending in the same direction as the side walls, having a shape corresponding to the product and constructed to releasably grasp product positioned in the cavity;

a cover for covering the base, with a cover having side walls; and a sleeve capable of being slipped over the based and the cover, wherein the side walls of the cover mate with the sidewalls of the base, thereby, forming an air cushion between the cover and the base for preventing the crushing of the product in the base, and wherein the first surface of the base is flocked so as to cooperate in releasably grasping the product in the cavity, wherein the side walls of the base are flocked, wherein the base is constructed of styrene, wherein there is provided a card for displaying graphical indicia relating to the product, the card being provided on a second surface of the base, wherein the cover is constructed of a transparent material, wherein the sleeve includes a top wall, a bottom wall and side walls, wherein the sleeve is provided with an outer surface and an inner surface, with the outer surface having graphical indicia relating to the product and with the inner surface having information relating to the product, and wherein the product is a flashlight.

18. The combination of a product and packaging for the product which comprises:

a product having a predetermined shape; and packaging for receiving, releasably grasping and protecting the product, the packaging including a base, a cover and a sleeve, the base having a first surface which defines a product receiving cavity for conformably accommodating the product and also having side walls extending from the first surface, said cavity extending in the same direction as the side walls, having a shape that corresponds to the product and constructed to releasably grasp the product positioned in the cavity;

the cover constructed to cover the base side walls, and the sleeve capable of being slipped over the base and the cover;

wherein the side walls of the cover mate with the side walls of the base, thereby forming an air cushion between the cover and base for preventing crushing of the product fitted in the base.

19. The product and packaging of claim 18 wherein the product is a flashlight having exterior surfaces which form a parallelogram-like shape and wherein the cavity has a parallelogram-like shape for receiving and grasping the flashlight.

20. The product and packaging of claim 18 wherein the first surface defines a product-engaging rib-like construction within the cavity and extending into the cavity so as to engage the product and limit its movement into the cavity.

21. The product and packaging of claim 20 wherein the rib-like construction extends substantially about the cavity interior.

22. The product and packaging of claim 20 wherein the side walls include a lower edge and a flange which extends from the lower edge in a direction away from the cavity and constructed to cooperate with the cover and limit the extent that the cover can be fitted over the base.

* * * * *